US012256847B1

(12) United States Patent
Wang

(10) Patent No.: US 12,256,847 B1
(45) Date of Patent: Mar. 25, 2025

(54) SEAT CUSHION

(71) Applicant: GUANGZHOU LIKEGAO IMPORT & EXPORT CO., LTD, Guangzhou (CN)

(72) Inventor: Bizhong Wang, Guangzhou (CN)

( * ) Notice: Subject to any disclaimer, the term of this patent is extended or adjusted under 35 U.S.C. 154(b) by 0 days.

(21) Appl. No.: 18/819,201

(22) Filed: Aug. 29, 2024

(51) Int. Cl.
*A47C 7/02* (2006.01)

(52) U.S. Cl.
CPC ..... *A47C 7/029* (2018.08)

(58) Field of Classification Search
CPC ..... A47C 7/029
See application file for complete search history.

(56) References Cited

U.S. PATENT DOCUMENTS 3,376,070 A * 4/1968 Johnson ..... A47C 7/029 297/452.25 X
5,288,135 A * 2/1994 Forcier ..... A61G 5/1064 297/452.21 X
5,297,848 A * 3/1994 Grinnell ..... A47C 7/425 297/219.1
5,522,106 A * 6/1996 Harrison ..... A61G 5/1045 297/452.25 X
6,457,773 B1 * 10/2002 Gates ..... A47C 7/029 297/452.21
7,140,057 B2 * 11/2006 Hetzel ..... A61G 5/1043 297/452.26
7,350,869 B2 * 4/2008 Davidson ..... A47C 7/20 297/284.3
8,857,914 B2 * 10/2014 Adams ..... A47C 7/029 297/452.21 X
9,220,345 B2 * 12/2015 Davis ..... A47C 7/029
9,332,850 B2 * 5/2016 Krishtul ..... A47C 7/029
9,993,086 B2 * 6/2018 Harte ..... A47C 7/029
10,111,526 B2 * 10/2018 Davis ..... A47G 9/10
10,905,255 B1 * 2/2021 Miale ..... A47C 7/029
11,246,421 B2 * 2/2022 Cai ..... A47C 7/021
11,672,344 B2 * 6/2023 DuFresne ..... A47C 27/22 297/452.48
11,744,375 B2 * 9/2023 DuFresne ..... A47C 1/023 297/284.3
11,882,940 B2 * 1/2024 Murata ..... A47C 7/021
(Continued)

FOREIGN PATENT DOCUMENTS

FR 3140745 A1 * 4/2024 ..... A47C 7/021
KR 20110016425 A * 2/2011 ..... A47C 7/029
(Continued)

*Primary Examiner* — Rodney B White

(57) ABSTRACT

A seat cushion includes a seat cushion body. The seat cushion body includes a seating surface, a front side surface, a rear side surface, a left support surface, a right support surface, and a bottom surface. The seating surface is configured to support buttocks and legs of a seated person. The front side surface is connected to the seating surface and configured to be disposed adjacent to the legs of the seated person. The rear side surface is connected to the seating surface and arranged opposite to the front side surface. The rear side surface is arranged adjacent to the back waist of the seated person. The left support surface and the right support surface are connected to the seating surface and oppositely arranged. The bottom surface is connected to the left support surface, the right support surface, the front side surface, and the rear side surface.

19 Claims, 6 Drawing Sheets

(56) References Cited

U.S. PATENT DOCUMENTS

| | | | | |
|---|---|---|---|---|
| 12,114,786 | B2 * | 10/2024 | DuFresne | A47C 7/029 |
| 2003/0121103 | A1 * | 7/2003 | Wempe | A61G 5/1045 5/654 |
| 2012/0068507 | A1 * | 3/2012 | Debevec | A47D 1/103 297/250.1 |
| 2012/0119560 | A1 * | 5/2012 | Wu | A47C 7/029 297/452.21 |
| 2013/0198961 | A1 * | 8/2013 | Davis | A47C 7/029 5/648 |
| 2023/0000254 | A1 * | 1/2023 | O'Doherty | A61G 5/1045 |

FOREIGN PATENT DOCUMENTS

| | | | | | |
|---|---|---|---|---|---|
| KR | 2018032050 | A | * | 3/2018 | A44B 18/00 |
| KR | 2019026087 | A | * | 3/2019 | A47C 7/021 |
| KR | 2019066131 | A | * | 6/2019 | A47C 3/16 |
| KR | 2020000061 | U | * | 1/2020 | A47C 7/021 |
| WO | WO-9639908 | A1 | * | 12/1996 | A47C 31/126 |
| WO | WO-9963868 | A1 | * | 12/1999 | A47C 7/029 |
| WO | WO-2011019165 | A2 | * | 2/2011 | A47C 7/029 |
| WO | WO-2014104048 | A1 | * | 7/2014 | A47C 7/029 |
| WO | WO-2020022792 | A1 | * | 1/2020 | A47C 7/029 |
| WO | WO-2020214978 | A1 | * | 10/2020 | A47C 7/029 |

* cited by examiner

SEAT CUSHION

TECHNICAL FIELD

The present invention relates to the field of seat cushions, in particular to a seat cushion.

BACKGROUND

In modern life, as people's living standards continuously improve, the demand for the quality of daily necessities is on the rise. Particularly for workers who spend most of their time sitting in the office every day, the demand for seat cushions should not be underestimated.

In the present market, the majority of existing seat cushions are constructed in a flat design with a simplistic structure. This fails to conform to the physiological structure of the human buttocks. Moreover, most modifications to seat cushions are merely centered around aesthetics and do not take into account people's requirements for different degrees of comfort as well as the phenomena of buttock deformation and spinal discomfort that are prone to occur after prolonged sitting. As a result, these seat cushions not only cannot mitigate fatigue but may even exacerbate the feeling of exhaustion.

SUMMARY

In order to overcome the shortcomings of the prior art, the present disclosure provides a seat cushion, which meets the needs of the physiological structure of the hip of the seat holder, improves the comfort of the seat cushion, and plays the role of relieving the fatigue of the seat holder.

The technical solution adopted by the present disclosure to solve the technical problem is as follows.

The present disclosure provides a seat cushion, including a seat cushion body, the seat cushion body includes:

- a seating surface configured to support buttocks and legs of a seated person;
- a front side surface connected to the seating surface and configured to be disposed adjacent to the legs of the seated person;
- a rear side surface connected to the seating surface and arranged opposite to the front side surface, the rear side surface being arranged adjacent to the back waist of the seated person;
- a left support surface and a right support surface, the left support surface and the right support surface being connected to the seating surface and oppositely arranged;
- a bottom surface connected to the left support surface, the right support surface, the front side surface, and the rear side surface;
- wherein the seat cushion body is provided with an arc-shaped dent sunken from the seating surface towards the bottom surface, and the arc-shaped dent is arranged adjacent to one end of the rear side surface.

As an improvement of the present disclosure, a relative width of the left support surface and the right support surface gradually decreases along the front side surface toward the rear side surface, so that the seat cushion body having a front-wide-and-rear-narrow structure is formed.

As an improvement of the present disclosure, one end of the seat cushion body adjacent to the left support surface is provided with a raised left support part; and a height of the seating surface gradually increases along a left end of the seating surface toward the left side support surface, so that the raised left side support part is formed.

As an improvement of the present disclosure, one end of the seat cushion body adjacent to the right support surface is provided with a raised right support part; and a height of the seating surface gradually increases along a right end of the seating surface toward the right side support surface, so that the raised right side support part is formed.

As an improvement of the present disclosure, the seat cushion body is provided a first cushioning dent sunken from the left support surface toward the right support surface.

As an improvement of the present disclosure, the first cushioning dent is disposed along the left side support surface and partially extends to the rear side surface and/or the front side surface.

As an improvement of the present disclosure, the first cushioning dent is an arc-shaped first cushioning dent, and a depth of the first cushioning dent gradually decreases along a middle part of the left support surface toward the seating surface and the bottom surface respectively.

As an improvement of the present disclosure, the maximum depth value of the first cushioning dent ranges from 10 mm to 30 mm.

As an improvement of the present disclosure, the seat cushion body is provided a second cushioning dent sunken from the right support surface toward the left support surface.

As an improvement of the present disclosure, the second cushioning dent is disposed along the right side support surface and partially extends to the rear side surface and/or the front side surface.

As an improvement of the present disclosure, the second cushioning dent is an arc-shaped first cushioning dent, and a depth of the second cushioning dent gradually decreases along a middle of the right support surface toward the seating surface and the bottom surface respectively.

As an improvement of the present disclosure, one end of the seat cushion body adjacent to the rear side surface is provided with a raised rear waist support part, and the raised rear waist support part is gradually raised from the seating surface along the arc-shaped dent towards the rear side surface and extends to the rear side surface. As an improvement of the present disclosure, the rear waist support part, the arc-shaped dent and an end of the seat cushion body adjacent to the front side surface, jointly forms a transverse 'S'-shaped structure.

As an improvement of the present disclosure, a height of the rear waist support part gradually decreases along a middle part of the seat cushion body towards the left support surface and the right support surface respectively.

As an improvement of the present disclosure, the rear waist support part is provided with an avoidance slit passing through the rear waist support part, the avoidance slit is configured to avoid a coccyx of the seated person.

As an improvement of the present disclosure, the arc-shaped dent is provided with an avoidance through hole, the avoidance through hole passes through the seat cushion body and connects to the avoidance slit, and the avoidance through hole is configured to avoid the coccyx of the seated person. As an improvement of the present disclosure, one end of the seat cushion body adjacent to the front side surface is provided with a separating protrusion, the separating protrusion is arranged in the middle of the seating surface, the separating protrusion, the seating surface and the left support surface form a sunken first leg support part, and the separating protrusion, the seating surface and the right support surface form a sunken second leg support part.

As an improvement of the present disclosure, a distance value between the separating protrusion and the left support surface ranges from 250 mm to 280 mm; a distance value between the separating protrusion and the right support surface ranges from 250 mm to 280 mm.

As an improvement of the present disclosure, a brinell hardness of the seat cushion body is as follows: when a force of 6.920 kgf is applied, a deformation of the seat cushion body is 25%; when a force of 10.340 kgf is applied, a deformation of the seat cushion body is 40%; when a force of 16.920 kgf is applied, a deformation of the seat cushion body is 65%.

As an improvement of the present disclosure, a ratio of the force value when the seat cushion body is depressed to 25% of its original thickness to the force value when it is depressed to 40% is 0.669; a ratio of the force value when the seat cushion body is depressed to 65% of its original thickness to the force value when it is depressed to 40% is 1.636.

Beneficial effects: The present disclosure provides a seat cushion. The seat cushion includes a seat cushion body, the seat cushion body includes a seating surface, a front side surface, a rear side surface, a left support surface, a right support surface, and a bottom surface. The seating surface is configured to support buttocks and legs of a seated person; a front side surface. The front side surface is connected to the seating surface and configured to be disposed adjacent to the legs of the seated person. The rear side surface is connected to the seating surface and arranged opposite to the front side surface, the rear side surface is arranged adjacent to the back waist of the seated person. The left support surface and the right support surface are connected to the seating surface and oppositely arranged. The bottom surface is connected to the left support surface, the right support surface, the front side surface, and the rear side surface. Furthermore, the seat cushion body is provided with an arc-shaped dent sunken from the seating surface towards the bottom surface, and the arc-shaped dent is arranged adjacent to one end of the rear side surface. Through the above structure, when the seated person sits down in the sitting direction adapted to the seat cushion body, the buttocks of the seated person and the arc-shaped dent naturally fit. Compared with a traditional flat seat cushion on the market, the arc-shaped dent is designed to make the user's buttocks sink naturally, disperses the weight pressure evenly, reduces the pressure on the ischium, avoids discomfort or fatigue caused by long-term sitting posture, and provides a more ergonomic support effect, thereby improving the user experience.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
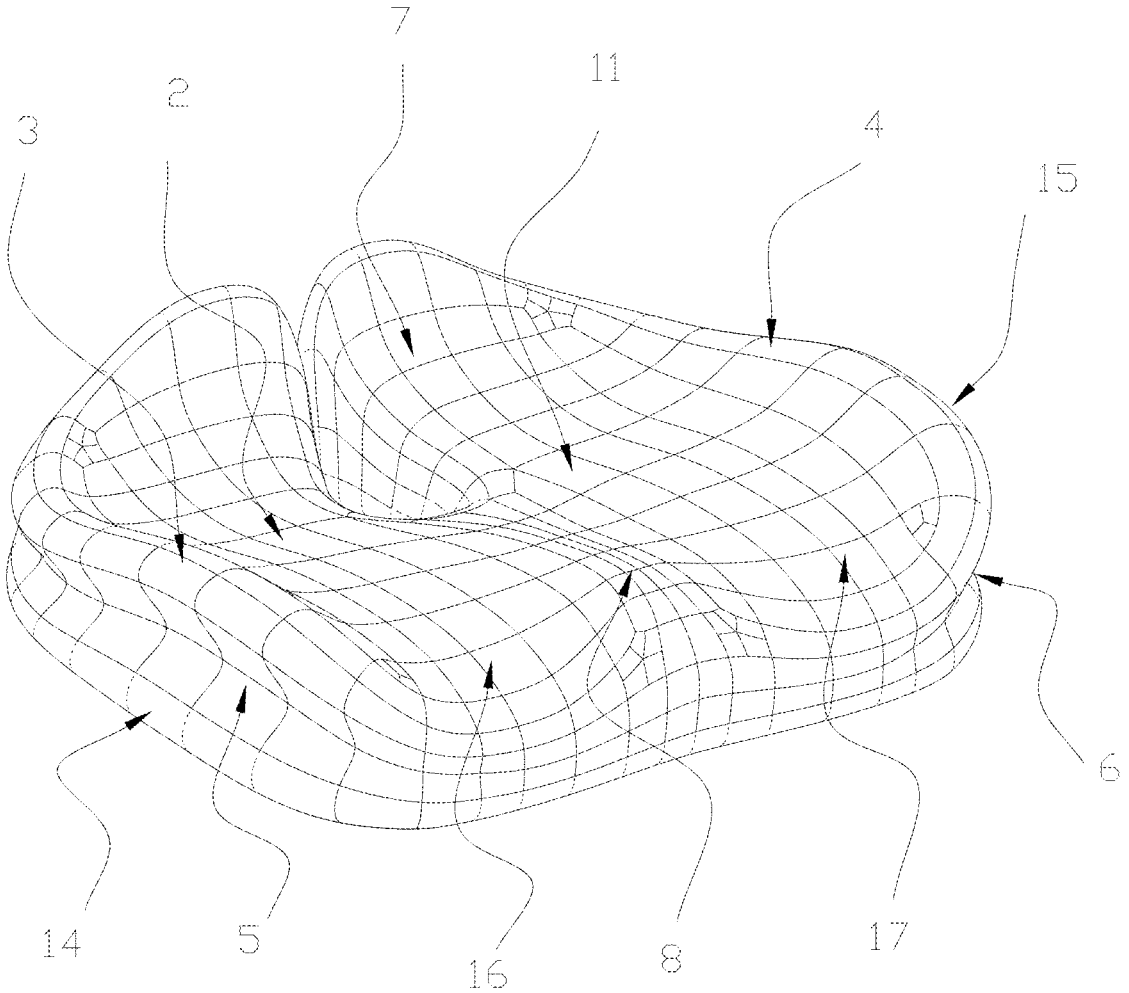
FIG. 1 is a schematic diagram of a seat cushion body of the present invention.
Figure 2:
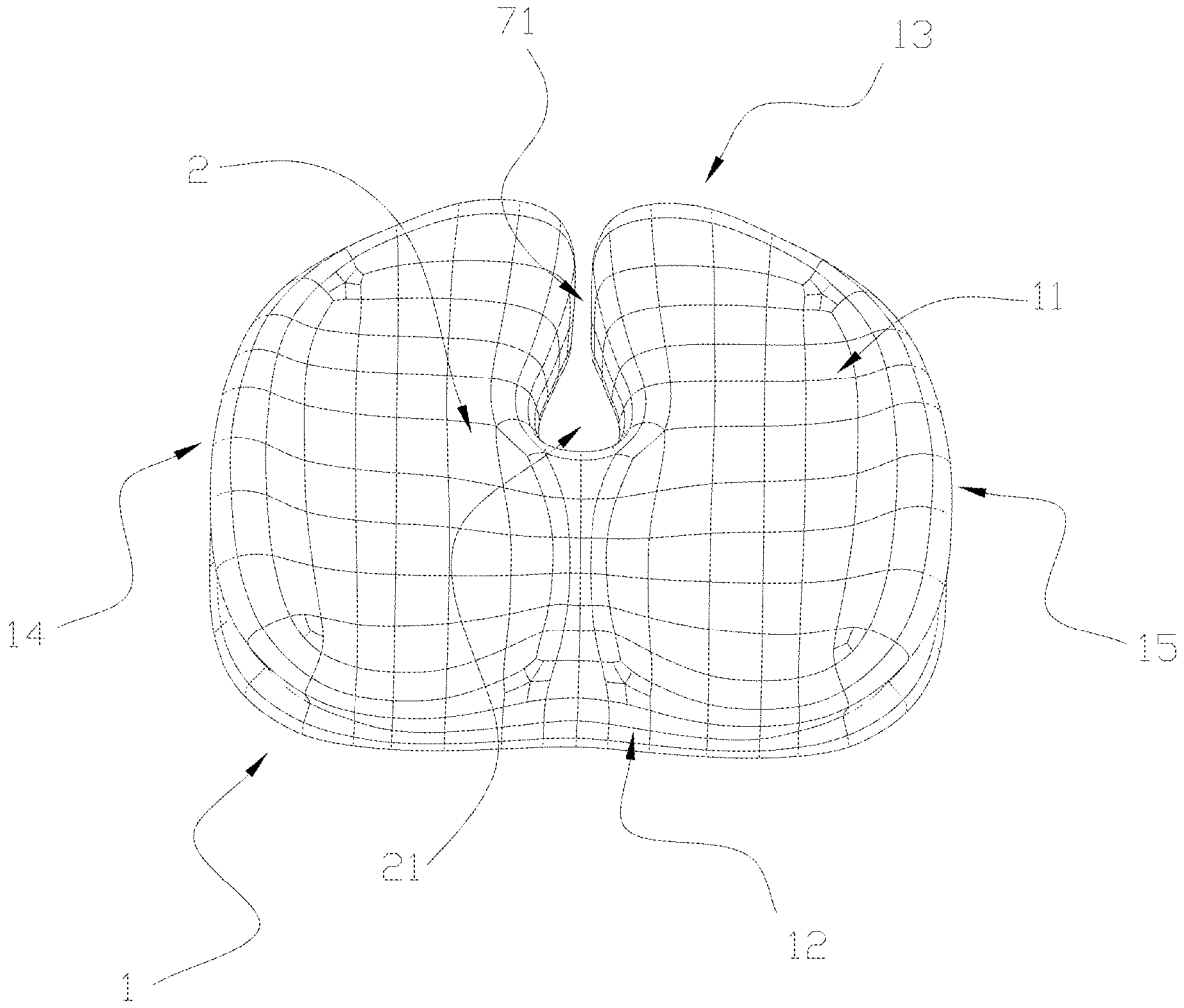
FIG. 2 is a top view diagram of the seat cushion body of the present invention.
Figure 3:
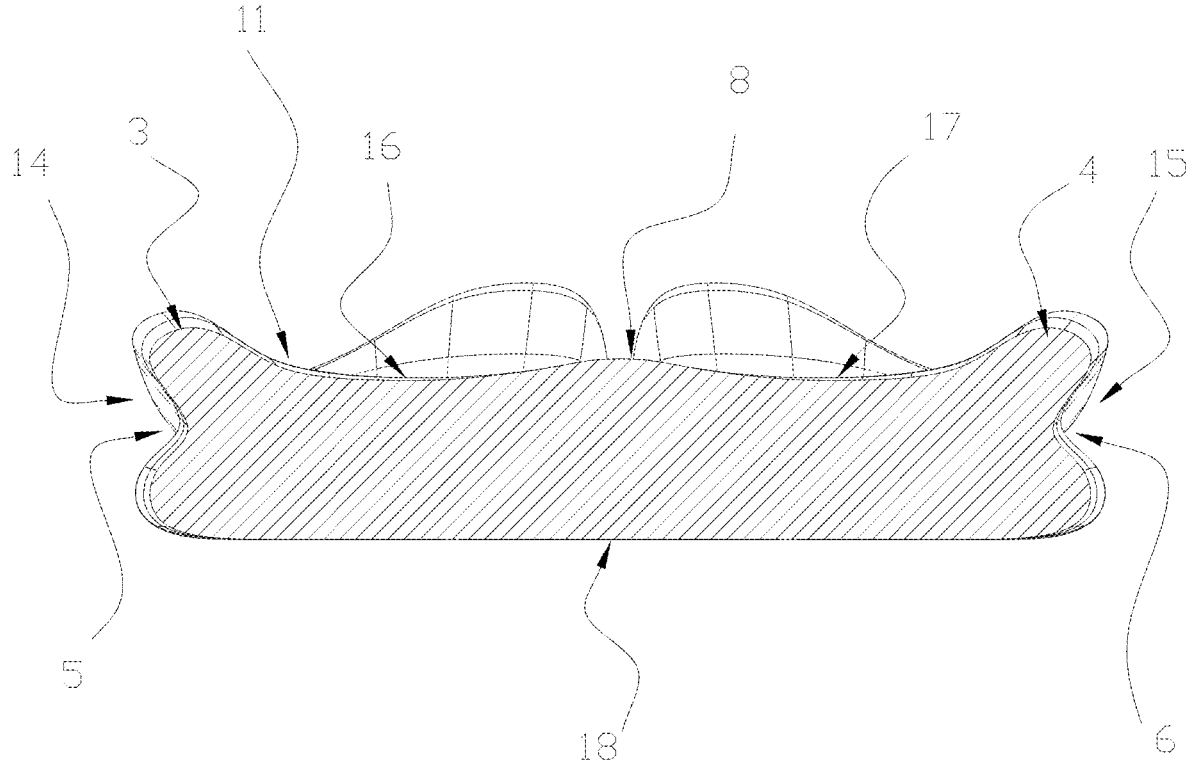
FIG. 3 is a sectional diagram cut along a separating protrusion of the present invention.
Figure 4:
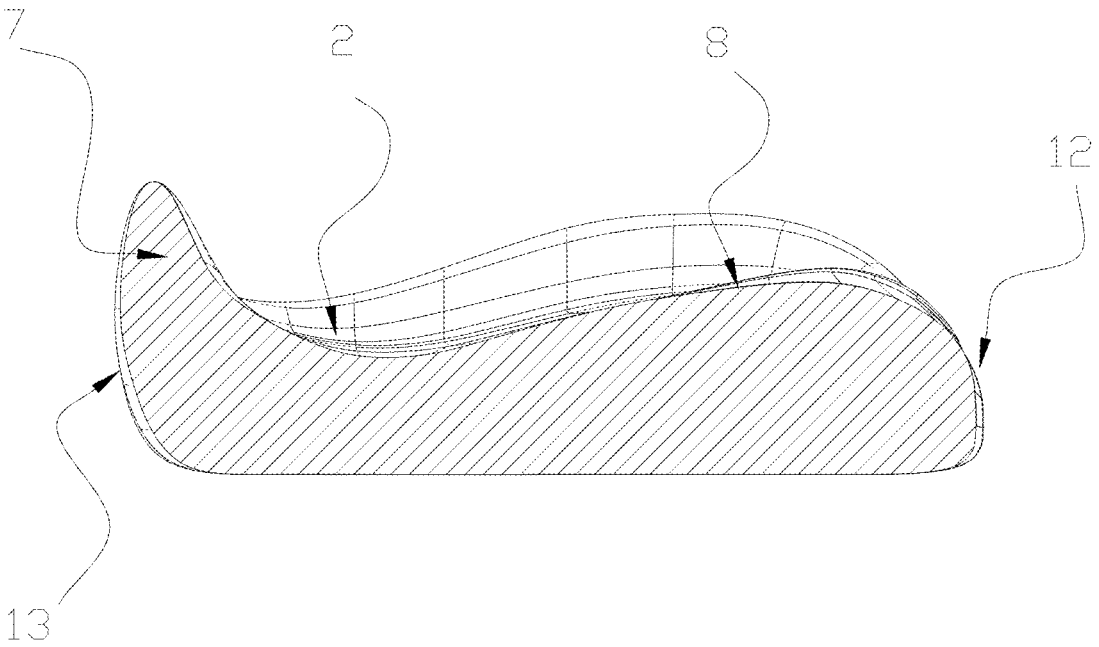
FIG. 4 is a sectional diagram cut along a arc-shaped dent of the present invention.

Referring to FIG. 1 to FIG. 4, a seat cushion includes a seat cushion body 1, the seat cushion body 1 includes a seating surface 11, a front side surface 12, a rear side surface 13, a left support surface 14, a right support surface 15, and a bottom surface 18. The seating surface 11 is configured to support buttocks and legs of a seated person. The front side surface 12 is connected to the seating surface 11 and configured to be disposed adjacent to the legs of the seated person. The rear side surface 13 is connected to the seating surface 11 and arranged opposite to the front side surface 12. The rear side surface 13 is arranged adjacent to the back waist of the seated person. The left support surface 14 and the right support surface 15 are connected to the seating surface 11 and oppositely arranged. The bottom surface 18 is connected to the left support surface 14, the right support surface 15, the front side surface 12, and the rear side surface 13. Furthermore, the seat cushion body 1 is provided with an arc-shaped dent 2 sunken from the seating surface 11 towards the bottom surface 18, and the arc-shaped dent 2 is arranged adjacent to one end of the rear side surface 13. Through the above structure, when the seated person sits down in the sitting direction adapted to the seat cushion body 1, the buttocks of the seated person and the arc-shaped dent 2 naturally fit. Compared with a traditional flat seat cushion on the market, the arc-shaped dent 2 is designed to make the user's buttocks sink naturally, disperses the weight pressure evenly, reduces the pressure on the ischium, avoids discomfort or fatigue caused by long-term sitting posture, and provides a more ergonomic support effect, thereby improving the user experience.

In this embodiment, a relative width of the left support surface 14 and the right support surface 15 gradually decreases along the front side surface 12 toward the rear side surface 13, so that the seat cushion body 1 having a front-wide-and-rear-narrow structure is formed. Through the above structure, the design of the seat cushion body 1 with the front-wide-and-rear-narrow structure enables a user to obtain a more comfortable supporting effect when sitting down. It is more accommodating to people with larger builds or those who are obese. It can also improve the seat cushion's wrapping property, so that the buttocks and legs of the user are more fitted with the seat cushion, thereby further enhancing the comfort and supporting effect of sitting posture.

In this embodiment, one end of the seat cushion body 1 adjacent to the left support surface 14 is provided with a raised left support part 3. Specifically, a height of the seating surface 11 gradually increases along a left end of the seating surface 11 toward the left side support surface 14, so that the raised left side support part 3 is formed. One end of the seat cushion body 1 adjacent to the right support surface 15 is provided with a raised right support part 4. Specifically, a height of the seating surface 11 gradually increases along a right end of the seating surface 11 toward the right side support surface 15, so that the raised right side support part 4 is formed. Through the above structure, the design of the raised left support part 3 and the raised right support part 4 is able to better wrap and support the user's buttocks and the outer sides of the thighs, preventing lateral sliding when sitting down and effectively enhancing the stability and comfort of the seat cushion. Moreover, it can provide additional lateral support. Especially when the user changes sitting postures or uses it for a long time, it can help maintain the correct sitting posture and reduce the pressure on the waist and buttocks.

In this embodiment, the seat cushion body 1 is provided a first cushioning dent 5 sunken from the left support surface 14 toward the right support surface 15. Specifically, the first cushioning dent 5 is disposed along the left side support surface 14 and partially extends to the rear side surface 13 and/or the front side surface 12. And the seat cushion body 1 is provided a second cushioning dent 6 sunken from the right support surface 15 toward the left support surface 14. Specifically, the second cushioning dent 6 is disposed along the right side support surface 15 and partially extends to the rear side surface 13 and/or the front side surface 12. Through the above structure, when a seated person sits on the seat cushion body 1, since there are the first cushioning dent 5 and the second cushioning dent 6 respectively on both sides of the seat cushion body 1, the design of the cushioning dents can provide a more appropriate sense of support for the seated person and a more fitting supporting effect, which helps to reduce the fatigue feeling when sitting for a long time and improve the overall comfort. Furthermore, the first cushioning dent 5 is an arc-shaped first cushioning dent 5, and a depth of the first cushioning dent 5 gradually decreases along a middle part of the left support surface 14 toward the seating surface 11 and the bottom surface 18 respectively. The maximum depth value of the first cushioning dent 5 ranges from 10 mm to 30 mm. Preferably, the maximum depth value of the first cushioning dent 5 is 22 mm. And the second cushioning dent 6 is an arc-shaped first cushioning dent 6, and a depth of the second cushioning dent 6 gradually decreases along a middle of the right support surface 15 toward the seating surface 11 and the bottom surface 18 respectively. The maximum depth value of the second cushioning dent 6 ranges from 10 mm to 30 mm. Preferably, the maximum depth value of the second cushioning dent 6 is 22 mm.

In this embodiment, one end of the seat cushion body 1 adjacent to the rear side surface 13 is provided with a raised rear waist support part 7, the raised rear waist support part 7 is gradually raised from the seating surface 11 along the arc-shaped dent 2 towards the rear side surface 13 and extends to the rear side surface 13, a height of the rear waist support part 7 gradually decreases along a middle part of the seat cushion body 1 towards the left support surface 14 and the right support surface 15 respectively. Through the above structure, the design of the rear waist support part 7 is capable of providing more effective support for the user's waist. Particularly during extended periods of sitting, it can assist in maintaining the natural curvature of the spine, reduce pressure on the lumbar vertebrae, and avert waist discomfort or pain resulting from improper sitting postures.

In this embodiment, the rear waist support part 7, the arc-shaped dent 2 and an end of the seat cushion body 1 adjacent to the front side surface 12, jointly forms a transverse 'S'-shaped structure. Through the above structure, the transverse "S"-shaped design is crafted to perfectly align with the natural curves of the human body. Specifically in terms of supporting the waist, buttocks, and thighs. The protruding portion of the rear waist support part 7 offers effective support to the user's lumbar spine, facilitating the maintenance of the natural curvature of the spine and reducing waist fatigue and discomfort. At the same time, the design of the arc-shaped dent 2 makes the user's buttocks to naturally sink, evenly distributing body weight pressure and minimizing pressure on the ischium. In accordance with ergonomic principles, it provides users with a more natural and comfortable sitting support experience.

In this embodiment, the rear waist support part 7 is provided with an avoidance slit 71 passing through the rear waist support part 7, the avoidance slit 71 is configured to avoid a coccyx of the seated person. Furthermore, the arc-shaped dent 2 is provided with an avoidance through hole 21, the avoidance through hole 21 passes through the seat cushion body 1 and connects to the avoidance slit 71, and the avoidance through hole 21 is configured to avoid the coccyx of the seated person. Through the above structure, with this through design, the seat cushion forms an avoidance area for the coccyx part, which can avoid the pressure on the coccyx caused by the long-term sitting posture of the seated person. At the same time, the combination of the avoidance through hole 21 and the avoidance slit 71 can also promote air circulation, enhance the breathability of the seat cushion, and reduce local stuffiness and moisture that may be caused by long-term sitting.

In this embodiment, one end of the seat cushion body 1 adjacent to the front side surface 12 is provided with a separating protrusion 8, the separating protrusion 8 is arranged in a middle of the seating surface 11, the separating protrusion 8, the seating surface 11 and the left support surface 14 form a sunken first leg support part 16, and the separating protrusion 8, the seating surface 11 and the right support surface 15 form a sunken second leg support part 17. Through the above structure, the separating protrusion 8 can effectively guide and fix the position of the user's legs, preventing the legs from unnaturally shifting inward or outward when sitting. This not only enhances the stability of the sitting posture but also helps the user maintain the correct leg posture, reducing muscle tension and fatigue caused by incorrect leg positions. Moreover, the concave design of the leg support part enables the seat cushion to better fit the curve of the user's thighs, reducing leg suspension and the resulting discomfort. At the same time, it improves blood circulation and avoids leg numbness or fatigue caused by long-term sitting.

In this embodiment, a distance value between the separating protrusion 8 and the left support surface 14 ranges from 250 mm to 280 mm; a distance value between the separating protrusion 8 and the right support surface 15 ranges from 250 mm to 280 mm. Preferably, the distance value between the separating protrusion 8 and the left support surface 14 is 270 mm, the distance value between the separating protrusion 8 and the right support surface 15 is 270 mm. Through the above structure, the seat cushion area distribution formed by the design of this distance value is more in line with the body types of European and American people, providing more fitting support.

In this embodiment, brinell hardness is used to test the hardness of the seat cushion body, when a force of 6.920 kgf is applied, a deformation of the seat cushion body is 25%; when a force of 10.340 kgf is applied, a deformation of the seat cushion body is 40%; when a force of 16.920 kgf is applied, a deformation of the seat cushion body is 65%. And a ratio of the force value when the seat cushion body is depressed to 25% of its original thickness to the force value when it is depressed to 40% is 0.669; a ratio of the force value when the seat cushion body is depressed to 65% of its original thickness to the force value when it is depressed to 40% is 1.636.

Figure 5:
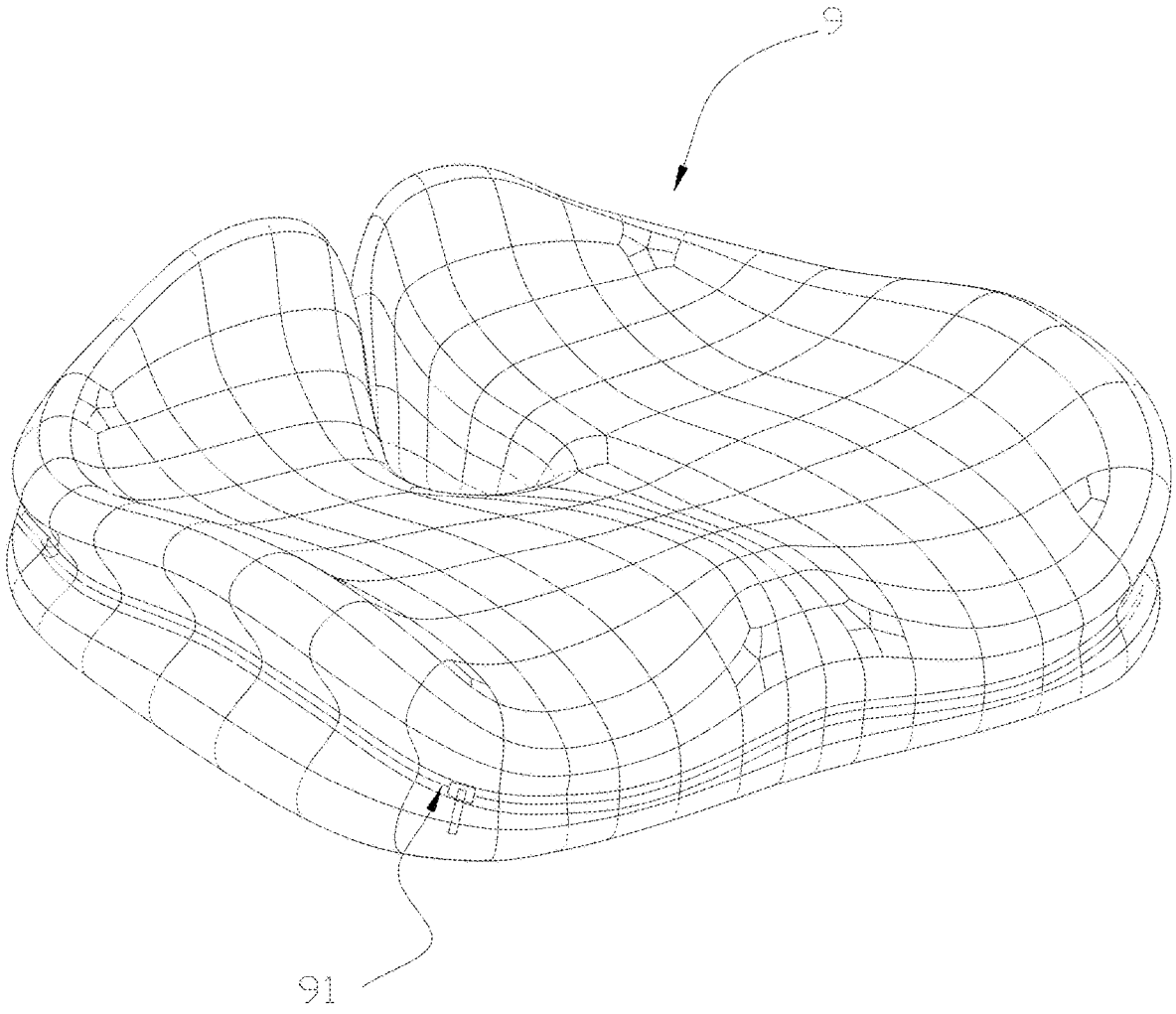
FIG. 5 is a schematic diagram of the seat cushion protective cover of the present invention.
Figure 6:
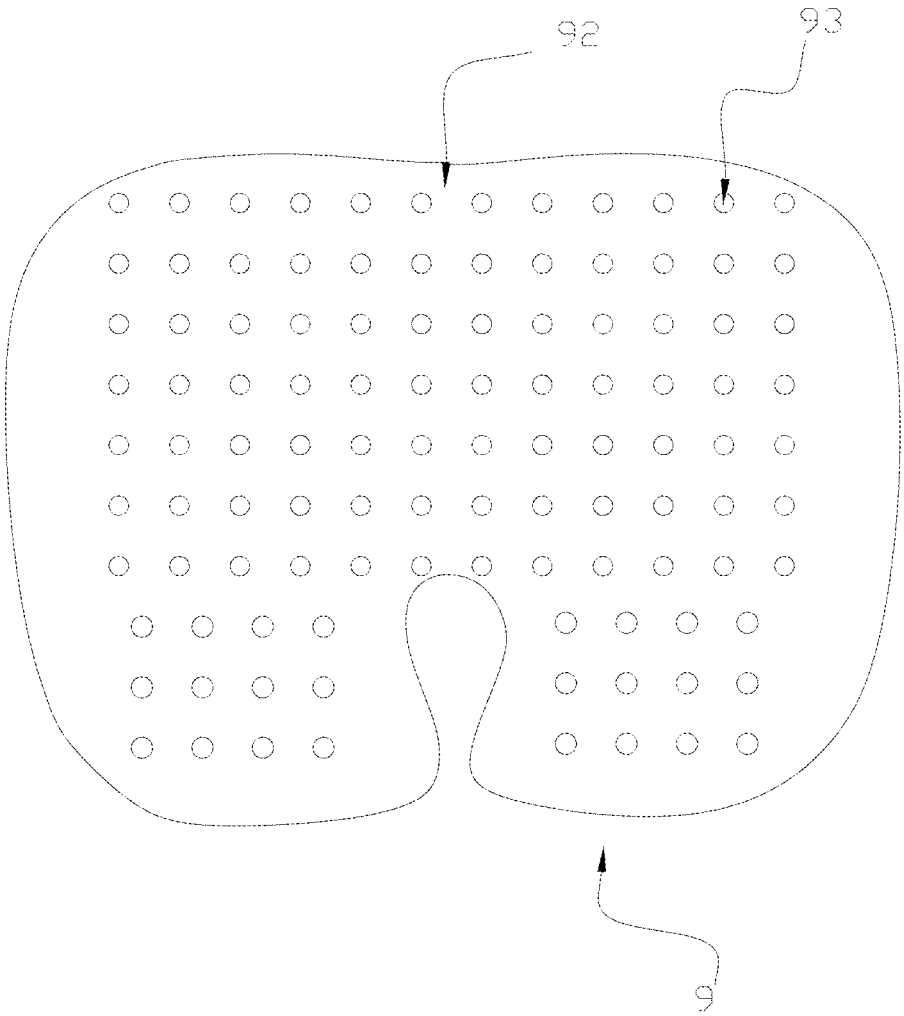
FIG. 6 is a schematic diagram of a bottom of a seat protective cover of the present invention.

In another embodiment, referring to FIG. 5 to FIG. 6, the seat cushion future includes a seat cushion protective cover 9. The seat cushion protective cover 9 is fitted over the surface of the seat cushion body 1. The external structure of the seat cushion protective cover 9 is adapted to the seat cushion body 1. The volume of the seat cushion protective cover 9 is slightly larger than the of the seat cushion body 1. Through the above structure, by fitting the seat cushion protective cover 9 onto the seat cushion body 1, it plays a role in protecting the seat cushion body 1, preventing the cushion body 1 from getting dirty, and increasing the service life of the seat cushion.

Furthermore, the seat cushion protective cover 9 is provided with a zipper 91, the zipper 91 is extended along the first cushioning dent 5, the second cushioning dent 6, the front side surface 12 and the rear side surface 13 which are corresponded to the seat cushion protective cover 9. Through the above structure, the zipper 91 is arranged in a middle of side walls around the seat cushion protective cover 9 and it is extended along the cushioning dent. When the user changes the seat cushion protective cover 9, the seat cushion protective cover 9 can be easily detached from or put on the seat cushion body 1 along the setting position of the zipper 91. It is convenient to use and beautiful. Moreover, since the zipper 91 is arranged on the side wall, when the seat cushion is placed on a sofa or other platform, compared with the existing design where the zipper 91 is arranged at the bottom of the seat cushion, the design of the zipper 91 will not scratch the surface of the sofa and prevent the zipper 91 from causing wear and tear to other valuable items.

In another embodiment, the design of zipper 91 is a concealed zipper design. Through hiding the zipper inside the seat cushion protective cover, the external structure of the seat cushion protective cover becomes more fashionable and beautiful. It also prevents the seated person from being injured by scraping against the zipper when carrying or using it.

Furthermore, a black anti-slip pad 92 is arranged at a bottom of the seat cushion protective cover 9, and several anti-slip protrusions 93 are distributed on the anti-slip pad 92. Through the above structure, several small anti-slip protrusions 93 are provided at the bottom of the protective cover. This increases the friction between the seat cushion and the sofa. The anti-slip protrusions 93 can be silicone protrusions. The silicone protrusions are relatively soft, ensuring that the seat cushion protective cover 9 will not cause wear and tear to items such as sofas.

In another embodiment, the seat cushion protective cover is made of black suede fabric. The suede fabric is made of 90% polyester and 10% spandex. Through the above structure, suede fabric as the material of the seat cushion protective cover makes the seat cushion protective cover soft and comfortable, providing a more comfortable sitting experience for the seated person.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A seat cushion, comprising a seat cushion body, the seat cushion body comprising:

a seating surface configured to support buttocks and legs of a seated person;

a front side surface connected to the seating surface and configured to be disposed adjacent to the legs of the seated person;

a rear side surface connected to the seating surface and arranged opposite to the front side surface, the rear side surface being arranged adjacent to the back waist of the seated person;

a left support surface and a right support surface, the left support surface and the right support surface being connected to the seating surface and oppositely arranged;

a bottom surface connected to the left support surface, the right support surface, the front side surface, and the rear side surface;

wherein the seat cushion body is provided with an arc-shaped dent sunken from the seating surface towards the bottom surface, and the arc-shaped dent is arranged adjacent to one end of the rear side surface;

wherein the seat cushion body is provided a first cushioning dent sunken from the left support surface toward the right support surface.

2. The seat cushion according to claim 1, wherein a relative width of the left support surface and the right support surface gradually decreases along the front side surface toward the rear side surface, so that the seat cushion body having a front-wide-and-rear-narrow structure is formed.

3. The seat cushion according to claim 1, wherein one end of the seat cushion body adjacent to the left support surface is provided with a raised left support part; and a height of the seating surface gradually increases along a left end of the seating surface toward the left side support surface, so that the raised left side support part is formed.

4. The seat cushion according to claim 1, wherein one end of the seat cushion body adjacent to the right support surface is provided with a raised right support part; and a height of the seating surface gradually increases along a right end of the seating surface toward the right side support surface, so that the raised right side support part is formed.

5. The seat cushion according to claim 1, wherein the first cushioning dent is disposed along the left side support surface and partially extends to the rear side surface and/or the front side surface.

6. The seat cushion according to claim 1, wherein the first cushioning dent is an arc-shaped first cushioning dent, and a depth of the first cushioning dent gradually decreases along a middle part of the left support surface toward the seating surface and the bottom surface respectively.

7. The seat cushion according to claim 6, wherein the maximum depth value of the first cushioning dent ranges from 10 mm to 30 mm.

8. A seat cushion, comprising a seat cushion body, the seat cushion body comprising:

a seating surface configured to support buttocks and legs of a seated person;

a front side surface connected to the seating surface and configured to be disposed adjacent to the legs of the seated person;

a rear side surface connected to the seating surface and arranged opposite to the front side surface, the rear side surface being arranged adjacent to the back waist of the seated person;

a left support surface and a right support surface, the left support surface and the right support surface being connected to the seating surface and oppositely arranged;

a bottom surface connected to the left support surface, the right support surface, the front side surface, and the rear side surface;

wherein the seat cushion body is provided with an arc-shaped dent sunken from the seating surface towards the bottom surface, and the arc-shaped dent is arranged adjacent to one end of the rear side surface;

wherein the seat cushion body is provided a second cushioning dent sunken from the right support surface toward the left support surface.

9. The seat cushion according to claim 8, wherein the second cushioning dent is disposed along the right side support surface and partially extends to the rear side surface and/or the front side surface.

10. The seat cushion according to claim 8, wherein the second cushioning dent is an arc-shaped first cushioning dent, and a depth of the second cushioning dent gradually decreases along a middle of the right support surface toward the seating surface and the bottom surface respectively.

11. The seat cushion according to claim 1, wherein one end of the seat cushion body adjacent to the rear side surface is provided with a raised rear waist support part, and the raised rear waist support part is gradually raised from the seating surface along the arc-shaped dent towards the rear side surface and extends to the rear side surface.

12. The seat cushion according to claim 11, wherein the rear waist support part, the arc-shaped dent and an end of the seat cushion body adjacent to the front side surface, jointly forms a transverse 'S'-shaped structure.

13. The seat cushion according to claim 11, wherein a height of the rear waist support part gradually decreases along a middle part of the seat cushion body towards the left support surface and the right support surface respectively.

14. The seat cushion according to claim 11, wherein the rear waist support part is provided with an avoidance slit passing through the rear waist support part, the avoidance slit is configured to avoid a coccyx of the seated person.

15. The seat cushion according to claim 14, wherein the arc-shaped dent is provided with an avoidance through hole, the avoidance through hole passes through the seat cushion body and connects to the avoidance slit, and the avoidance through hole is configured to avoid the coccyx of the seated person.

16. The seat cushion according to claim 1, wherein one end of the seat cushion body adjacent to the front side surface is provided with a separating protrusion, the separating protrusion is arranged in the middle of the seating surface, the separating protrusion, the seating surface and the left support surface form a sunken first leg support part, and the separating protrusion, the seating surface and the right support surface form a sunken second leg support part.

17. The seat cushion according to claim 16, wherein a distance value between the separating protrusion and the left support surface ranges from 250 mm to 280 mm; a distance value between the separating protrusion and the right support surface ranges from 250 mm to 280 mm.

18. The seat cushion according to claim 1, wherein a brinell hardness of the seat cushion body is as follows: when a force of 6.920 kgf is applied, a deformation of the seat cushion body is 25%; when a force of 10.340 kgf is applied, a deformation of the seat cushion body is 40%; when a force of 16.920 kgf is applied, a deformation of the seat cushion body is 65%.

19. The seat cushion according to claim 18, wherein a ratio of the force value when the seat cushion body is depressed to 25% of its original thickness to the force value when it is depressed to 40% is 0.669; a ratio of the force value when the seat cushion body is depressed to 65% of its original thickness to the force value when it is depressed to 40% is 1.636.

* * * * *